US008764156B1

(12) United States Patent
Ramesh et al.

(10) Patent No.: US 8,764,156 B1
(45) Date of Patent: Jul. 1, 2014

(54) SYSTEM AND METHOD FOR CONTROLLING DEWPOINT IN A PRINT ZONE WITHIN AN INKJET PRINTER

(71) Applicant: Xerox Corporation, Norwalk, CT (US)

(72) Inventors: Palghat S. Ramesh, Pittsford, NY (US); Paul J. McConville, Webster, NY (US); Chu-heng Liu, Penfield, NY (US); Anthony S. Condello, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 28 days.

(21) Appl. No.: 13/720,409

(22) Filed: Dec. 19, 2012

(51) Int. Cl.
*B41J 29/393* (2006.01)

(52) U.S. Cl.
USPC ..... 347/17; 347/19

(58) Field of Classification Search
CPC . B41J 2/04553; B41J 2/04556; B41J 2/04515
USPC ..... 347/17, 19
See application file for complete search history.

(56) References Cited

U.S. PATENT DOCUMENTS 5,365,261 A 11/1994 Ozawa et al.
5,528,271 A 6/1996 Ebisawa
5,778,298 A 7/1998 Enomoto et al.
6,079,814 A 6/2000 Lean et al.
6,491,364 B2 12/2002 Pietrzyk et al.
6,886,905 B2 5/2005 McElfresh et al.
6,997,538 B1 2/2006 Kawamura et al.
7,431,421 B2 10/2008 Carcia et al.
7,520,588 B2 4/2009 Domoto et al.
7,669,959 B2 3/2010 Sekimoto et al.
7,997,717 B2 8/2011 Taniuchi et al.
8,091,989 B2 1/2012 Desse
2005/0253912 A1* 11/2005 Smith et al. ..... 347/102
2007/0085879 A1 4/2007 May
2010/0295909 A1 11/2010 Doi et al.

* cited by examiner

*Primary Examiner* — Julian Huffman

(74) *Attorney, Agent, or Firm* — Maginot, Moore & Beck, LLP

(57) ABSTRACT

An aqueous inkjet printer includes a print zone with a relative humidity sensor and a temperature sensor. A controller identifies a dew point of air between a printhead and an intermediate imaging member with reference to the air temperature and the moisture in the air of the print zone, and identifies a target dew point with reference to the image data used to operate the printhead. The controller operates a heater and an air mover to adjust the dew point of the air between the printhead and the intermediate imaging member to the target dew point.

22 Claims, 4 Drawing Sheets

SYSTEM AND METHOD FOR CONTROLLING DEWPOINT IN A PRINT ZONE WITHIN AN INKJET PRINTER

TECHNICAL FIELD

This disclosure relates generally to indirect inkjet printers, and, in particular, to environmental controls in inkjet printers.

BACKGROUND

In general, inkjet printing machines or printers include at least one printhead that ejects drops or jets of liquid ink onto a recording or image forming surface. An aqueous inkjet printer employs water-based or solvent-based inks in which pigments or other colorants are suspended or in solution. Once the aqueous ink is ejected onto an image receiving surface by a printhead, the water or solvent is evaporated to stabilize the ink image on the image receiving surface. When aqueous ink is ejected directly onto media, the aqueous ink tends to soak into the media when it is porous, such as paper, and change the physical properties of the media. To address this issue, indirect printers have been developed that eject ink onto a blanket mounted to a drum or endless belt. The ink is dried on the blanket and then transferred to media. Such a printer avoids the changes in media properties that occur in response to media contact with the water or solvents in aqueous ink. Indirect printers also reduce the effect of variations in other media properties that arise from the use of widely disparate types of paper and films used to hold the final ink images.

In aqueous ink indirect printing, an aqueous ink is jetted on to an intermediate imaging surface, typically called a blanket, and the ink is partially dried on the blanket prior to transfixing the image to a media substrate, such as a sheet of paper. The intermediate imaging member to which the blanket is mounted is heated to maintain the blanket at a temperature within a range about a predetermined temperature. This temperature is selected to heat the ink very quickly to begin evaporating some of the water and/or solvent as soon as the ink impacts the surface of the blanket. Typically, this temperature is at least 100 degrees C. and evaporation commences within milliseconds of the drops hitting the blanket surface. Once the ink drops impact the blanket, the drops also spread. The spreading is conditioned on the impact velocity, capillary wetting, surface energy, and viscous damping effects of the blanket surface.

When ink is ejected onto a hot blanket, evaporation of the ink causes moisture to enter the air in the print zone between the blanket and the printhead. The amount of moisture introduced into the air is directly proportional to the amount of ink ejected by the printheads in the print zone. The moisture can diffuse across the gap between the printhead and the blanket and condense on the printhead if the temperature of the printhead is sufficiently low. Condensation on a printhead face can interfere with the effective and efficient operation of a printhead.

Heating the printhead to a temperature that discourages condensation also adversely affects the printhead. If an inkjet is not operating at fairly frequent rate, the ink in a nozzle of an inkjet may dry out and clog the inkjet. Even if the printhead is not heated to avoid condensation, the heat transfer between the hot blanket and the printhead may affect inkjets in the printhead. Specifically, heat transfers from the blanket to the printhead from radiation and convection mechanisms. This heat transfer can cause ink to dry in the nozzles of inkjets that are not operated at a rate that replaces the ink at the nozzle before it dries. Therefore, enabling evaporation of ink on the blanket quickly after impact without negatively affecting the inkjets in the printhead is desirable.

SUMMARY

An inkjet printer has been configured to enable environmental control in a print zone. The printer includes a printhead configured to eject ink drops, and an intermediate imaging member that rotates proximate to the printhead to enable the printhead to eject ink drops on the intermediate imaging member to form an ink image on the intermediate imaging member, the intermediate imaging member is configured to maintain a temperature that is greater than a temperature of the printhead. An air mover is configured to move air between the printhead and the intermediate imaging member. A relative humidity sensor is configured to generate a signal indicative of an amount of moisture in air and is positioned to measure moisture in air between the intermediate imaging member and the printhead. A temperature sensor is configured to generate a signal indicative of a temperature and is positioned to measure temperature in air between the intermediate imaging surface and the printhead. A heater is positioned to heat air between the printhead and the intermediate imaging member, and a print engine is configured to render data for an image, the rendered data being used to operate the printhead to form the ink image on the intermediate imaging member. A controller is operatively connected to the heater, the temperature sensor, the relative humidity sensor, the air mover, and the print engine, and is configured to identify a dew point of air between the printhead and the intermediate imaging member with reference to the signal indicative of air temperature and the signal indicative of moisture in air, to identify a target dew point with reference to the rendered data, and to operate the heater and the air mover to adjust the dew point of air between the printhead and the intermediate imaging member to the target dew point.

A method of operating a printer also enables control of the environment in the print zone of the printer. The method includes rendering image data to operate inkjets in a printhead to form an ink image on an intermediate imaging member rotating proximate to the printhead, and maintaining the intermediate imaging member at a temperature that is greater than a temperature of the printhead. A signal indicative of an amount of moisture in air between the intermediate imaging member and the printhead is generated as well as a signal indicative of a temperature in air between the intermediate imaging surface and the printhead. A dew point of air between the printhead and the intermediate imaging member is identified with reference to the signal indicative of air temperature and the signal indicative of moisture in air, and a target dew point is identified with reference to the rendered data. A heater and an air mover are operated to adjust the dew point of the air between the printhead and the intermediate imaging member to the target dew point.

DETAILED DESCRIPTION

Figure 1:
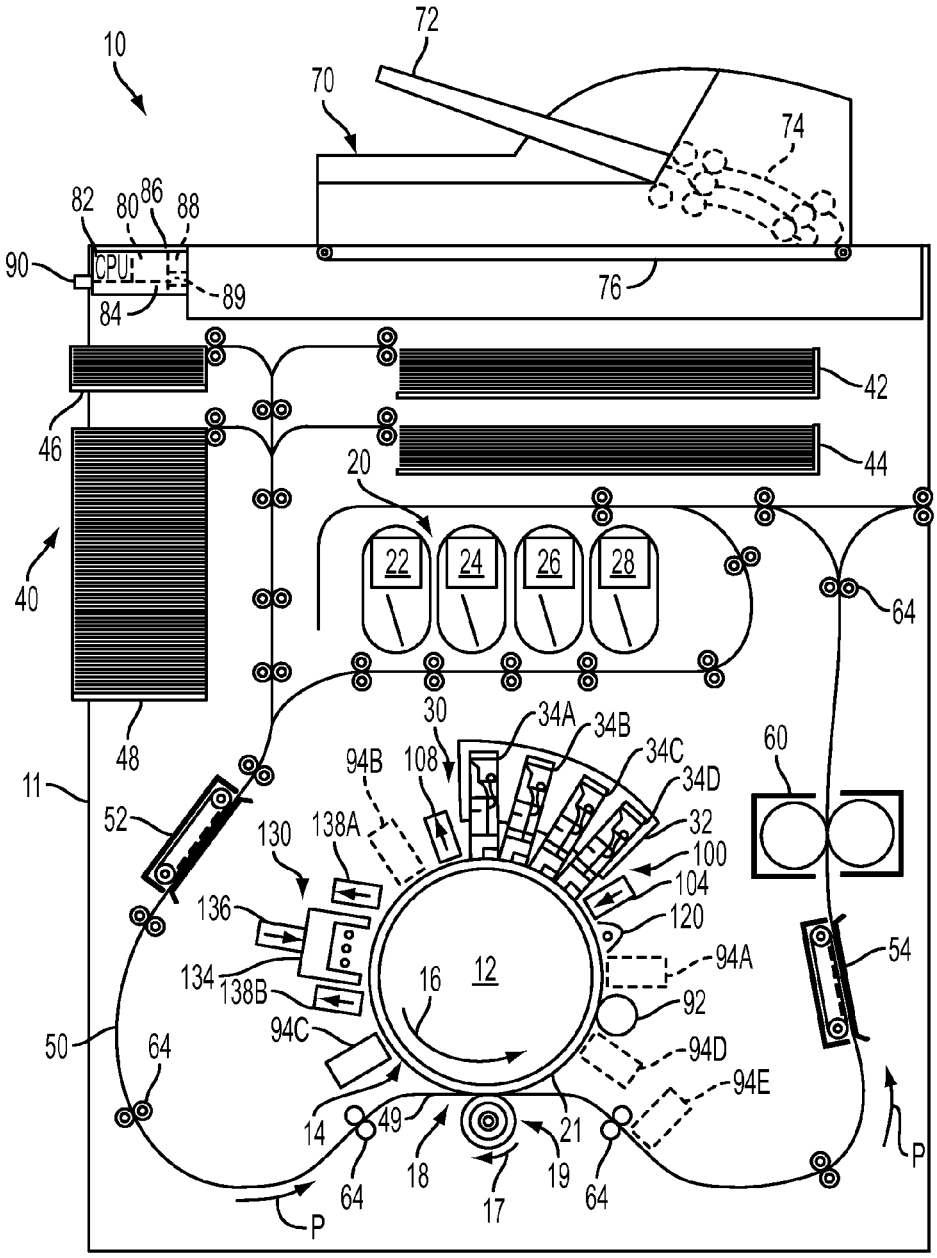
FIG. 1 is a schematic drawing of an aqueous indirect inkjet printer that produces images on sheet media.

For a general understanding of the present embodiments, reference is made to the drawings. In the drawings, like reference numerals have been used throughout to designate like elements. As used herein, the terms "printer," "printing device," or "imaging device" generally refer to a device that produces an image on print media with aqueous ink and may encompass any such apparatus, such as a digital copier, bookmaking machine, facsimile machine, multi-function machine, or the like, which generates printed images for any purpose. Image data generally include information in electronic form which are rendered and used to operate the inkjet ejectors to form an ink image on the print media. These data can include text, graphics, pictures, and the like. The operation of producing images with colorants on print media, for example, graphics, text, photographs, and the like, is generally referred to herein as printing or marking. Aqueous inkjet printers use inks that have a high percentage of water relative to the amount of colorant and/or humectant in the ink.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as a print medium or the surface of an intermediate member that carries an ink image, moves past the printheads in a process direction through the print zone. The inkjets in the printheads eject ink drops in rows in a cross-process direction, which is perpendicular to the process direction across the image receiving surface.

FIG. 1 illustrates a high-speed aqueous ink image producing machine or printer 10. As illustrated, the printer 10 is an indirect printer that forms an ink image on a surface of a blanket 21 mounted about a rotating support 12 and then transfers the ink image to media passing through a nip 18 formed with the blanket 21 and support 12. The printer 10 includes a frame 11 that supports directly or indirectly operating subsystems and components, which are described below. Although the printer 10 shows the support for the blanket 21 in the form of a drum, it can alternatively be configured as a supported endless belt. The support 12 has an outer blanket 21 mounted about the circumference of the support 12. The blanket moves in a direction 16 as the support 12 rotates. A transfix roller 19 rotatable in the direction 17 is loaded against the surface of blanket 21 to form a transfix nip 18, within which ink images formed on the surface of blanket 21 are transfixed onto a media sheet 49.

The blanket is formed of a material having a relatively low surface energy to facilitate transfer of the ink image from the surface of the blanket 21 to the media sheet 49 in the nip 18. Such materials include silicones, fluro-silicones, Viton, and the like. A surface maintenance unit (SMU) 92 removes residual ink left on the surface of the blanket 21 after the ink images are transferred to the media sheet 49. The low energy surface of the blanket does not aid in the formation of good quality ink images because such surfaces do not spread ink drops as well as high energy surfaces. Consequently, some embodiments of SMU 92 also apply a coating to the blanket surface. The coating helps aid in wetting the surface of the blanket, inducing solids to precipitate out of the liquid ink, providing a solid matrix for the colorant in the ink, and aiding in the release of the ink image from the blanket. Such coatings include surfactants, starches, and the like. In other embodiments, a surface energy applicator 120, which is described in more detail below, operates to treat the surface of blanket for improved formation of ink images without requiring application of a coating by the SMU 92.

The SMU 92 can include a coating applicator having a reservoir with a fixed volume of coating material and a resilient donor roller, which can be smooth or porous and is rotatably mounted in the reservoir for contact with the coating material. The donor roller can be an elastomeric roller made of a material such as anilox. The coating material is applied to the surface of the blanket 21 to form a thin layer on the blanket surface. The SMU 92 is operatively connected to a controller 80, described in more detail below, to enable the controller to operate the donor roller, metering blade and cleaning blade selectively to deposit and distribute the coating material onto the surface of the blanket and remove un-transferred ink pixels from the surface of the blanket 21.

The printer 10 includes an optical sensor 94A, also known as an image-on-drum ("IOD") sensor, which is configured to detect light reflected from the blanket surface 14 and the coating applied to the blanket surface as the support 12 rotates past the sensor. The optical sensor 94A includes a linear array of individual optical detectors that are arranged in the cross-process direction across the blanket 21. The optical sensor 94A generates digital image data corresponding to light that is reflected from the blanket surface 14 and the coating. The optical sensor 94A generates a series of rows of image data, which are referred to as "scanlines," as the support 12 rotates the blanket 21 in the direction 16 past the optical sensor 94A. In one embodiment, each optical detector in the optical sensor 94A further comprises three sensing elements that are sensitive to wavelengths of light corresponding to red, green, and blue (RGB) reflected light colors. Alternatively, the optical sensor 94A includes illumination sources that shine red, green, and blue light or, in another embodiment, the sensor 94A has an illumination source that shines white light onto the surface of blanket 21 and white light detectors are used. The optical sensor 94A shines complementary colors of light onto the image receiving surface to enable detection of different ink colors using the photodetectors. The image data generated by the optical sensor 94A is analyzed by the controller 80 or other processor in the printer 10 to identify the thickness of the coating on the blanket and the area coverage. The thickness and coverage can be identified from either specular or diffuse light reflection from the blanket surface and/or coating. Other optical sensors, such as 94B, 94C, and 94D, are similarly configured and can be located in different locations around the blanket 21 to identify and evaluate other parameters in the printing process, such as missing or inoperative inkjets and ink image formation prior to image drying (94B), ink image treatment for image transfer (94C), and the efficiency of the ink image transfer (94D). Alternatively, some embodiments can include an optical sensor to generate additional data that can be used for evaluation of the image quality on the media (94E).

The printer 10 also includes a surface energy applicator 120 positioned next to the blanket surface at a position immediately prior to the surface of the blanket 21 entering the print zone formed by printhead modules 34A-34D. The construction and operation of the surface energy applicator 120 is described in more detail below. The applicator 120 can be, for example, a corotron, a scorotron, or biased charge roller. The applicator 120 can be, for example, a corotron, a scorotron, or biased charge roller. The coronode of a scorotron or corotron used in the applicator 120 can either be a conductor in an applicator operated with AC or DC electrical power or a dielectric coated conductor in an applicator supplied with only AC electrical power. The devices with dielectric coated coronodes are sometimes referred to as dicorotrons or discorotrons.

The surface energy applicator 120 is configured to emit an electric field between the applicator 120 and the surface of the blanket 21 that is sufficient to ionize the air between the two structures and apply negatively charged particles, positively charged particles, or a combination of positively and negatively charged particles to the blanket surface and/or the coating. The electric field and charged particles increase the surface energy of the blanket surface and/or coating. The increased surface energy of the surface of the blanket 21 enables the ink drops subsequently ejected by the printheads in the modules 34A-34D to be spread adequately to the blanket surface 21 and not coalesce.

The printer 10 includes an airflow management system 100, which generates and controls a flow of air through the print zone. The airflow management system 100 includes a printhead air supply 104 and a printhead air return 108. The printhead air supply 104 and return 108 are operatively connected to the controller 80 or some other processor in the printer 10 to enable the controller to manage the air flowing through the print zone. This regulation of the air flow can be through the print zone as a whole or about one or more printhead arrays. The regulation of the air flow helps prevent evaporated solvents and water in the ink from condensing on the printhead and helps attenuate heat in the print zone to reduce the likelihood that ink dries in the inkjets, which can clog the inkjets. The airflow management system 100 can also include sensors to detect humidity and temperature in the print zone to enable more precise control of the temperature, flow, and humidity of the air supply 104 and return 108 to ensure optimum conditions within the print zone. Controller 80 or some other processor in the printer 10 can also enable control of the system 100 with reference to ink coverage in an image area or even to time the operation of the system 100 so air only flows through the print zone when an image is not being printed.

The high-speed aqueous ink printer 10 also includes an aqueous ink supply and delivery subsystem 20 that has at least one source 22 of one color of aqueous ink. Since the illustrated printer 10 is a multicolor image producing machine, the ink delivery system 20 includes four (4) sources 22, 24, 26, 28, representing four (4) different colors CYMK (cyan, yellow, magenta, black) of aqueous inks. In the embodiment of FIG. 1, the printhead system 30 includes a printhead support 32, which provides support for a plurality of printhead modules, also known as print box units, 34A through 34D. Each printhead module 34A-34D effectively extends across the width of the blanket and ejects ink drops onto the surface 14 of the blanket 21. A printhead module can include a single printhead or a plurality of printheads configured in a staggered arrangement. Each printhead module is operatively connected to a frame (not shown) and aligned to eject the ink drops to form an ink image on the coating on the blanket surface 14. The printhead modules 34A-34D can include associated electronics, ink reservoirs, and ink conduits to supply ink to the one or more printheads. In the illustrated embodiment, conduits (not shown) operatively connect the sources 22, 24, 26, and 28 to the printhead modules 34A-34D to provide a supply of ink to the one or more printheads in the modules. As is generally familiar, each of the one or more printheads in a printhead module can eject a single color of ink. In other embodiments, the printheads can be configured to eject two or more colors of ink. For example, printheads in modules 34A and 34B can eject cyan and magenta ink, while printheads in modules 34C and 34D can eject yellow and black ink. The printheads in the illustrated modules are arranged in two arrays that are offset, or staggered, with respect to one another to increase the resolution of each color separation printed by a module. Such an arrangement enables printing at twice the resolution of a printing system only having a single array of printheads that eject only one color of ink. Although the printer 10 includes four printhead modules 34A-34D, each of which has two arrays of printheads, alternative configurations include a different number of printhead modules or arrays within a module.

After the printed image on the blanket surface 14 exits the print zone, the image passes under an image dryer 130. The image dryer 130 includes an infrared heater 134, a heated air source 136, and air returns 138A and 138B. The infrared heater 134 applies infrared heat to the printed image on the surface 14 of the blanket 21 to evaporate water or solvent in the ink. The heated air source 136 directs heated air over the ink to supplement the evaporation of the water or solvent from the ink. The air is then collected and evacuated by air returns 138A and 138B to reduce the interference of the air flow with other components in the printing area.

As further shown, the printer 10 includes a recording media supply and handling system 40 that stores, for example, one or more stacks of paper media sheets of various sizes. The recording media supply and handling system 40, for example, includes sheet or substrate supply sources 42, 44, 46, and 48. In the embodiment of printer 10, the supply source 48 is a high capacity paper supply or feeder for storing and supplying image receiving substrates in the form of cut media sheets 49, for example. The recording media supply and handling system 40 also includes a substrate handling and transport system 50 that has a media pre-conditioner assembly 52 and a media post-conditioner assembly 54. The printer 10 includes an optional fusing device 60 to apply additional heat and pressure to the print medium after the print medium passes through the transfix nip 18. In the embodiment of FIG. 1, the printer 10 includes an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the image receiving member 12, the printhead modules 34A-34D (and thus the printheads), the substrate supply and handling system 40, the substrate handling and transport system 50, and, in some embodiments, the one or more optical sensors 94A-94E. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead modules 34A-34D. As such, the ESS or controller 80 is the main multi-tasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80 from either the scanning system 76 or via the online or work station connection 90 for processing and generation of the printhead control signals output to the printhead modules 34A-34D. Additionally, the controller 80 determines and/or accepts related subsystem and component controls, for example, from operator inputs via the user interface 86, and accordingly executes such controls. As a result, aqueous ink for appropriate colors are delivered to the printhead modules 34A-34D. Additionally, pixel placement control is exercised relative to the blanket surface 14 to form ink images corresponding to the image data, and the media, which can be in the form of media sheets 49, are supplied by any one of the sources 42, 44, 46, 48 and handled by recording media transport system 50 for timed delivery to the nip 18. In the nip 18, the ink image is transferred from the blanket and coating 21 to the media substrate within the transfix nip 18.

In some printing operations, a single ink image can cover the entire surface 14 of the blanket 21 (single pitch) or a plurality of ink images can be deposited on the blanket 21 (multi-pitch). In a multi-pitch printing architecture, the surface of the image receiving member can be partitioned into multiple segments, each segment including a full page image in a document zone (i.e., a single pitch) and inter-document zones that separate multiple pitches formed on the blanket 21. For example, a two pitch image receiving member includes two document zones that are separated by two inter-document zones around the circumference of the blanket 21. Likewise, for example, a four pitch image receiving member includes four document zones, each corresponding to an ink image formed on a single media sheet, during a pass or revolution of the blanket 21.

Once an image or images have been formed on the blanket and coating under control of the controller 80, the illustrated inkjet printer 10 operates components within the printer to perform a process for transferring and fixing the image or images from the blanket surface 14 to media. In the printer 10, the controller 80 operates actuators to drive one or more of the rollers 64 in the media transport system 50 to move the media sheet 49 in the process direction P to a position adjacent the transfix roller 19 and then through the transfix nip 18 between the transfix roller 19 and the blanket 21. The transfix roller 19 applies pressure against the back side of the recording media 49 in order to press the front side of the recording media 49 against the blanket 21 and the image receiving member 12. Although the transfix roller 19 can also be heated, in the exemplary embodiment of FIG. 1, the transfix roller 19 is unheated. Instead, the pre-heater assembly 52 for the media sheet 49 is provided in the media path leading to the nip. The pre-conditioner assembly 52 conditions the media sheet 49 to a predetermined temperature that aids in the transferring of the image to the media, thus simplifying the design of the transfix roller. The pressure produced by the transfix roller 19 on the back side of the heated media sheet 49 facilitates the transfixing (transfer and fusing) of the image from the support 12 onto the media sheet 49.

The rotation or rolling of both the support 12 and transfix roller 19 not only transfixes the images onto the media sheet 49, but also assists in transporting the media sheet 49 through the nip. The support 12 continues to rotate to enable the printing process to be repeated.

Figure 2:
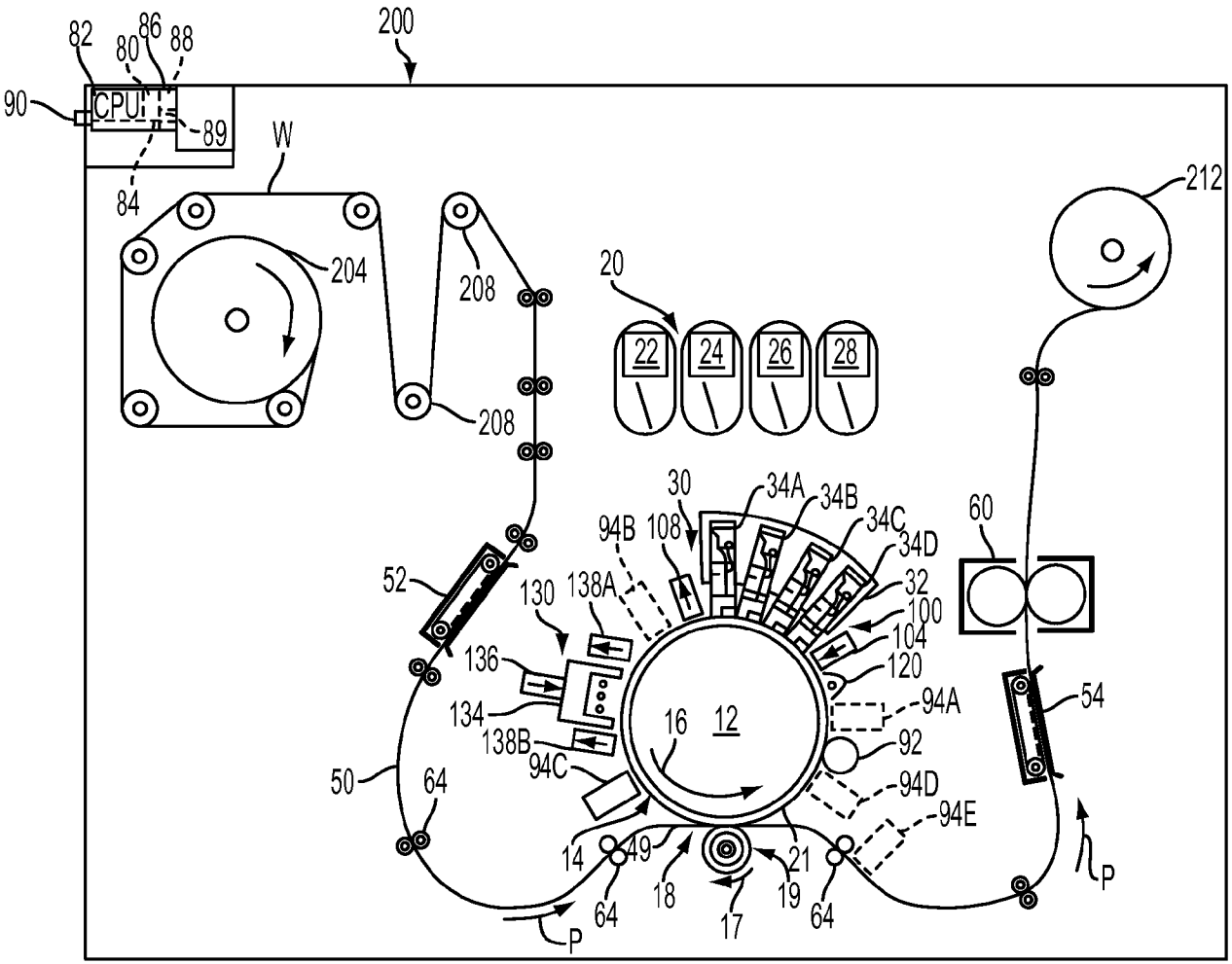
FIG. 2 is a schematic drawing of an aqueous indirect inkjet printer that produces images on a continuous web of media.

In the embodiment shown in FIG. 2, like components are identified with like reference numbers used in the description of the printer in FIG. 1. One difference between the printers of FIG. 1 and FIG. 2 is the type of media used. In the embodiment of FIG. 2, a media web W is unwound from a roll of media 204 as needed and a variety of motors, not shown, rotate one or more rollers 208 to propel the media web W through the nip 18 so the media web W can be wound onto a roller 212 for removal from the printer. One configuration of the printer 200 winds the printed media onto a roller for removal from the system by rewind unit 214. Alternatively, the media can be directed to other processing stations that perform tasks such as cutting, binding, collating, and/or stapling the media or the like. One other difference between the printers 10 and 200 is the nip 18. In the printer 200, the transfer roller continually remains pressed against the blanket 21 as the media web W is continuously present in the nip. In the printer 10, the transfer roller is configured for selective movement towards and away from the blanket 21 to enable selective formation of the nip 18. Nip 18 is formed in this embodiment in synchronization with the arrival of media at the nip to receive an ink image and is separated from the blanket to remove the nip as the trailing edge of the media leaves the nip.

Figure 3:
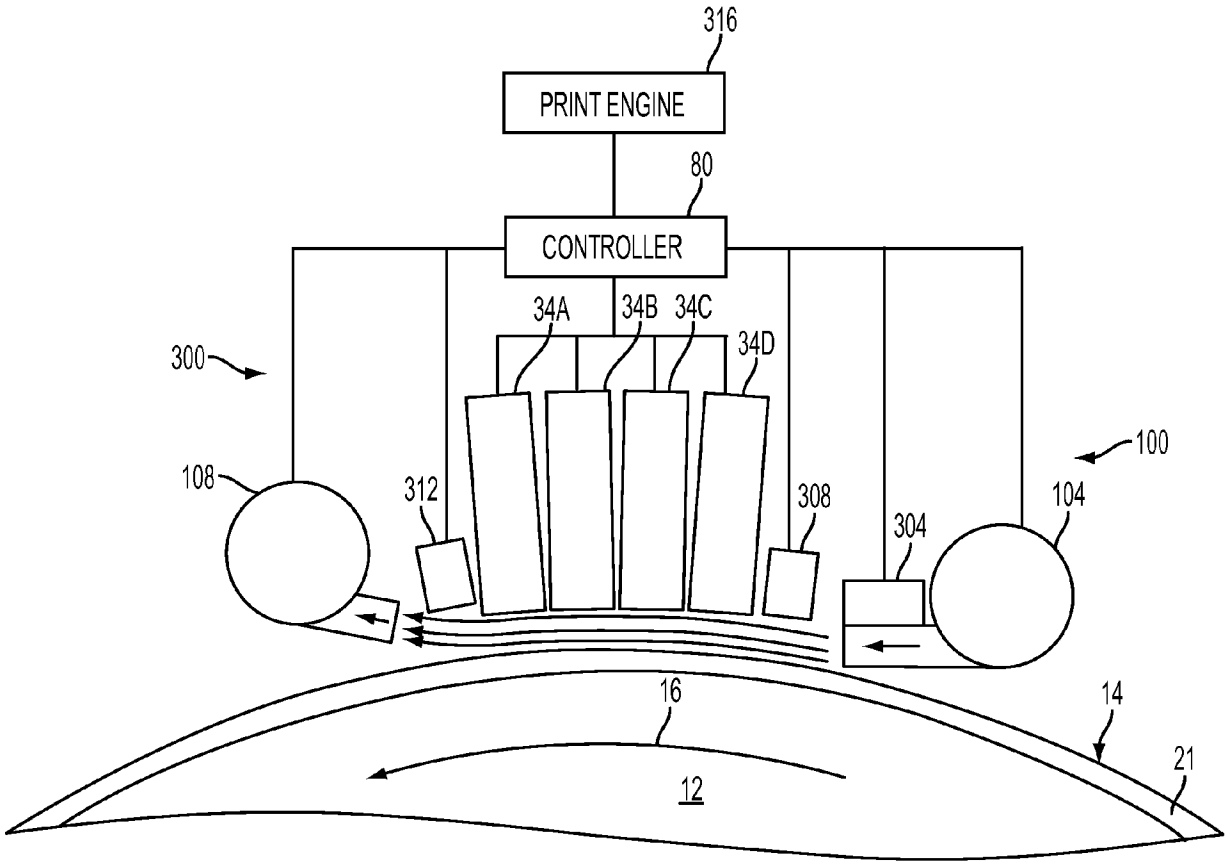
FIG. 3 shows the print zone of the printer in FIG. 1 in more detail.

The print zone 300 of the printer 10 is shown in more detail in FIG. 3. The print zone 300 includes the support 12, printheads 34A-34D, and airflow management system 100. As is described above, the support 12 includes a blanket 21 having a blanket surface 14, on which the printheads 34A-34D are configured to eject aqueous ink to form an ink image. The support 12 rotates in direction 16 to move the ink image formed on the blanket 21 out of the print zone 300 and enable the image to be subsequently transferred to print media.

The airflow management system 100 includes a positive pressure source 104, a negative pressure source 108, a heater 304, a temperature sensor 308, and a relative humidity sensor 312. The positive pressure source 104 and negative pressure source 108 are configured to produce airflow through the print zone 300 between the printheads 34A-34D and the blanket 21. The pressure sources 104 and 108 are operatively connected to the controller 80, which operates the pressure sources as described below. In the illustrated embodiment, the pressure sources 104 and 108 are configured to force air through the print zone 300 in direction 16. In other embodiments, the positions of the positive pressure source 104 and the negative pressure source 108 can be reversed to enable airflow in a direction opposite of the rotation of the image receiving member 12. Furthermore, the airflow management system 100 can be configured with only one of the positive pressure source 104 and the negative pressure source 108 to produce airflow through the print zone. The pressure sources 104 and 108 can be any suitable type of pressure source, for example a centrifugal blower or a fan.

The heater 304 is positioned between the positive pressure source 104 and the printheads 34A-34D and is configured to apply heat to the air before the air passes between the printheads 34A-34D and the rotating support 12. The heater 304 is operatively connected to the controller 80, which generates electronic signals to activate and deactivate the heater 304. The heater 304 can be an infrared heater, a convective heater, or any other heater suitable for heating the air. In some embodiments, the heater 304 is positioned within or connected to the positive pressure source 104, such that air flowing from the positive pressure source 104 is heated.

Temperature sensor 308 and humidity sensor 312 are positioned proximate to the printheads 34A-34D. The temperature sensor 308 detects a temperature in the print zone 300 and generates a signal corresponding to the detected temperature. Likewise, the humidity sensor 312 detects relative humidity in the print zone 300 and generates a corresponding humidity signal. Both the temperature and humidity signals are delivered to the controller 80, which processes the signals and operates the pressure sources 104 and 108 and the heater 304 as described below. Although the temperature sensor 308 is depicted upstream of the printheads 34A-34D and the humidity sensor 312 is depicted downstream of the printheads 34A-34D in FIG. 3, the reader should appreciate that the temperature and humidity sensors can be positioned at any suitable location proximate to or in between the printheads. Furthermore, in some embodiments, the airflow management system can include two or more temperature and humidity sensors to enable measurement of the temperature and humidity at various locations in the print zone.

The controller 80 is operatively connected to the print engine 316, the printheads 34A-34D, the positive pressure source 104, the negative pressure source 108, the heater 304, the temperature sensor 308, and the humidity sensor 312. The controller 80 is configured to receive electronic signals generated by the temperature and humidity sensors 308 and 312. The print engine receives image data that the print engine renders to produce color separation data. The controller 80 uses the rendered image data to generate firing signals that are used to operate the inkjets in the printheads 34A-34D. The controller 80 operates the pressure sources 104 and 108 and the heater 304 with reference to the sensor signals and the rendered image data.

Figure 4:
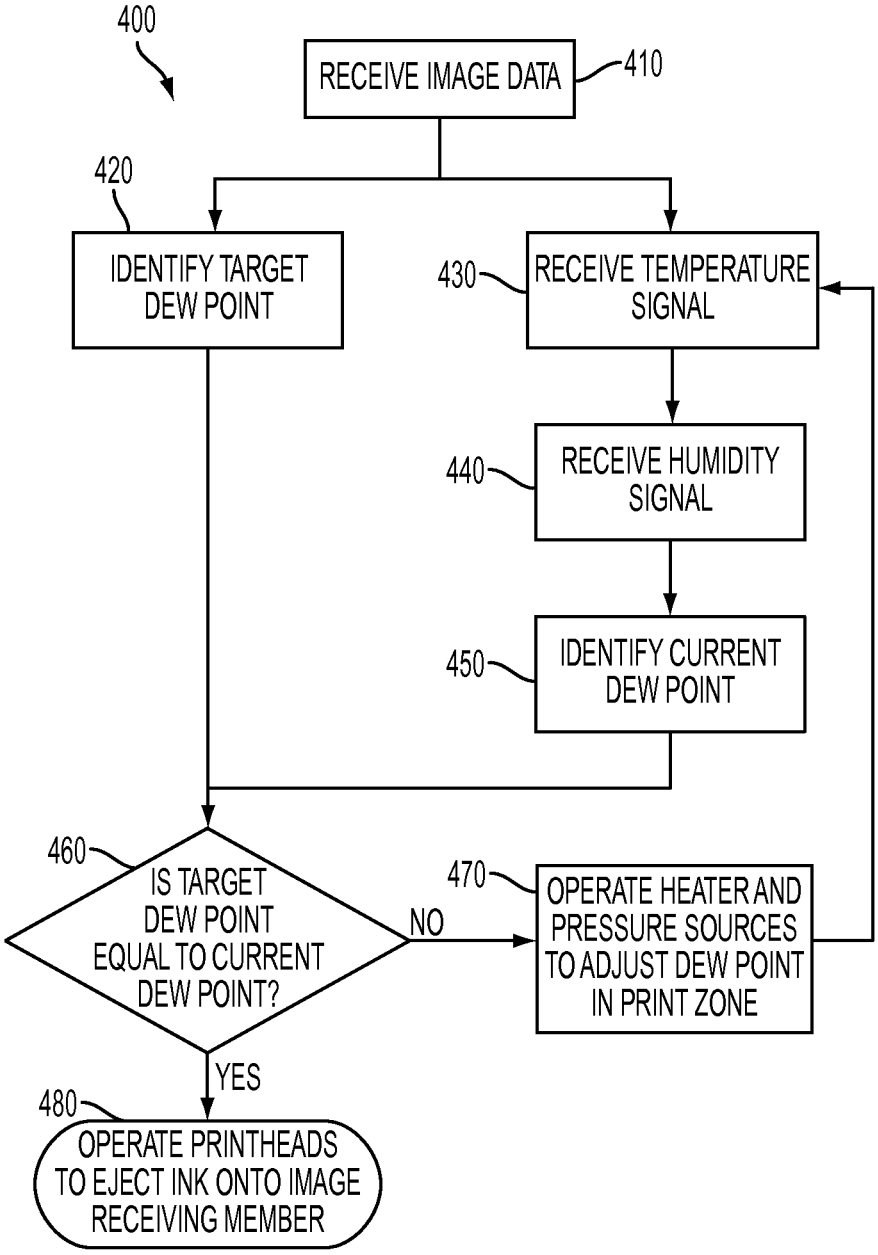
FIG. 4 is a flow diagram of a process for controlling the dew point of the air in the print zone of FIG. 3.

FIG. 4 depicts a process 400 for controlling the dew point in the environment of the print zone. As used in this document, "dew point" refers to the temperature below which the water vapor in a volume of humid air at a constant barometric pressure condenses into liquid water. The dew point is associated with relative humidity. A high relative humidity indicates the dew point is close to the current air temperature. Relative humidity of 100% indicates the dew point is equal to the current temperature and that the air is maximally saturated with water. When the dew point remains constant and temperature increases, relative humidity decreases. The process 400 refers to a controller, such as the controller 80 described above, executing programmed instructions stored in a memory operatively connected to the controller to cause the controller to operate one or more components of the printer to perform the specified function or action described in the process. The process begins with the controller receiving rendered image data from a print engine (block 410). The image data corresponds to an ink image to be printed on the blanket or other image receiving member passing by the printheads for subsequent transfer to a print media. The controller proceeds to process the image data and calculate a target dew point for the print zone based on the quantity of ink to be ejected to form the ink image (block 420). At the same time, the controller receives a signal corresponding to the temperature in the print zone from a temperature sensor located near or in the zone (block 430) and a signal corresponding to the humidity in the print zone from a humidity sensor located near or in the zone (block 440). The controller uses the temperature and humidity signals to calculate the current dew point in the print zone (block 450). The calculated target dew point is compared with the current dew point (block 460). If the target dew point is not equal to the current dew point, the controller operates the heater to increase the temperature in the print zone and/or operates the pressure sources to adjust the airflow through the print zone to modify the dew point in the print zone (block 470). The process then continues from block 430 until current and target dew points are equal. If the target dew point is equal to the current dew point, then the controller maintains the operation of the heater and the pressure sources at their present level and operates the printheads to eject ink onto the blanket surface of the image receiving member to print the ink image. In some embodiments, the printer can be configured to continually repeat the processing described with reference to blocks 410 to block 480 to identify the target and current dew points as the ink is ejected onto the image receiving member, and adjust the operation of the heater and pressure sources as the ink image is printed. "Identify" as used in this document refers to any calculation, arithmetic or logical operation, which is used to measure or quantify in some manner a parameter or characteristic.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

a printhead configured to eject ink drops;

an intermediate imaging member that rotates proximate to the printhead to enable the printhead to eject ink drops on the intermediate imaging member to form an ink image on the intermediate imaging member, the intermediate imaging member being configured to maintain a temperature that is greater than a temperature of the printhead;

an air mover configured to move air between the printhead and the intermediate imaging member;

a relative humidity sensor configured to generate a signal indicative of an amount of moisture in air, the relative humidity sensor being positioned to measure moisture in air between the intermediate imaging member and the printhead;

a temperature sensor configured to generate a signal indicative of a temperature, the temperature sensor being positioned to measure temperature in air between the intermediate imaging surface and the printhead;

a heater positioned to heat air between the printhead and the intermediate imaging member;

a print engine configured to render data for an image, the rendered data being used to operate the printhead to form the ink image on the intermediate imaging member; and a controller operatively connected to the heater, the temperature sensor, the relative humidity sensor, the air mover, and the print engine, the controller being configured to identify a dew point of air between the printhead and the intermediate imaging member with reference to the signal indicative of air temperature and the signal indicative of moisture in air, to identify a target dew point with reference to the rendered data, and to operate the heater and the air mover to adjust the dew point of air between the printhead and the intermediate imaging member to the target dew point.

2. The printer of claim 1, the air mover further comprising:

a positive pressure source configured to push air between the printhead and the intermediate imaging member.

3. The printer of claim 1, the air mover further comprising:

a negative pressure source configured to pull air between the printhead and the intermediate imaging member.

4. The printer of claim 1 wherein the intermediate imaging surface is configured to maintain a temperature in a predetermined range about 100 degrees C. and the printhead is configured to maintain a temperature in a range below 50 degrees C.

5. The printer of claim 1, the heater being positioned to heat air prior to the air moving between the printhead and the intermediate imaging member.

6. The printer of claim 1, the printhead being further configured to eject aqueous ink.

7. The printer of claim 1, the controller being further configured to identify the target dew point with reference to an amount of ink to be ejected that corresponds to the rendered data.

8. The printer of claim 1, the controller being further configured to adjust a speed of the air moved by the air mover with reference to the amount of ink to be ejected.

9. The printer of claim 1, the controller being further configured to adjust a temperature of the heater with reference to the amount of ink to be ejected.

10. The printer of claim 1, the controller being further configured to operate the air mover to move air between the printhead and the intermediate imaging member only during periods in which the printhead is not ejecting ink drops.

11. The printer of claim 1, the controller being further configured to identify the target dew point with reference to a rate of ejection for at least one inkjet in the printhead.

12. A method of operating a printer comprising:

rendering image data to operate inkjets in a printhead to form an ink image on an intermediate imaging member rotating proximate to the printhead;

maintaining the intermediate imaging member at a temperature that is greater than a temperature of the printhead;

generating a signal indicative of an amount of moisture in air between the intermediate imaging member and the printhead;

generating a signal indicative of a temperature in air between the intermediate imaging surface and the printhead;

identifying a dew point of air between the printhead and the intermediate imaging member with reference to the signal indicative of air temperature and the signal indicative of moisture in air;

identifying a target dew point with reference to the rendered data; and operating a heater and an air mover to adjust the dew point of the air between the printhead and the intermediate imaging member to the target dew point.

13. The method of claim 12, the operation of the air mover further comprising:

operating a positive pressure source to push air between the printhead and the intermediate imaging member.

14. The method of claim 12, the operation of the air mover further comprising:

operating a negative pressure source to pull air between the printhead and the intermediate imaging member.

15. The method of claim 12, the maintenance of the temperature of the intermediate imaging surface further comprising:

maintaining the temperature of the intermediate image member in a predetermined range about 100 degrees C.; and maintaining a temperature of the printhead in a range below 50 degrees C.

16. The method of claim 12, the operation of the heater further comprising:

operating the heater to heat air prior to the air moving between the printhead and the intermediate imaging member.

17. The method of claim 12 further comprising:

operating the printhead to eject aqueous ink.

18. The method of claim 12 further comprising:

identifying the target dew point with reference to an amount of ink to be ejected that corresponds to the rendered data.

19. The method of claim 12, the operation of the air mover further comprising:

adjusting a speed of the air moved by the air mover with reference to the amount of ink to be ejected.

20. The method of claim 12, the operation of heater further comprising:

adjusting a temperature of the heater with reference to the amount of ink to be ejected.

21. The method of claim 12, the operation of the air mover further comprising:

operating the air mover to move air between the printhead and the intermediate imaging member only during periods in which the printhead is not ejecting ink drops.

22. The method of claim 12, the identification of the target dew point further comprising:

identifying the target dew point with reference to a rate of ejection for at least one inkjet in the printhead.

* * * * *